United States Patent [19]

Desplats

[11] 4,294,429

[45] Oct. 13, 1981

[54] PULLEY ASSEMBLY FOR IMPROVING THE COOPERATION BETWEEN A WINCH AND A CABLE ACTUATED THEREBY

[75] Inventor: André Desplats, Boulogne Billancourt, France

[73] Assignee: Tractel S.A., France

[21] Appl. No.: 66,276

[22] Filed: Aug. 13, 1979

[30] Foreign Application Priority Data

Aug. 22, 1978 [FR] France ..... 78 24359

[51] Int. Cl.[3] ..... B66D 1/74

[52] U.S. Cl. ..... 254/272; 254/287; 254/333

[58] Field of Search ..... 254/214–216, 254/272, 281, 284, 285, 287, 333, 335–337, 342, 371, 374, 382, 395, 396, 397, 902

[56] References Cited

U.S. PATENT DOCUMENTS 3,118,635 1/1964 Landsem ..... 254/333 X
3,666,239 5/1972 Koshihara ..... 254/287
3,944,185 3/1976 Evans ..... 254/333 X
3,949,969 4/1976 Kaufer ..... 254/333

*Primary Examiner*—John M. Jillions
*Attorney, Agent, or Firm*—William A. Drucker

[57] ABSTRACT

In this cable hoisting apparatus at least two pulleys disposed in a common plane have in the one a semi-circular-sectioned groove and in the other a V-shaped groove section, the first pulley receiving the load and the other pulley being responsive to the tightening mechanism controlled by the load. Thus, the pulley having a semi-circular sectioned groove will not damage the cable and the cable is retained therein by adherence, thus reducing as much the load exerted on the cable section engaging the second pulley, whereby a lesser retaining effort is exerted on this second pulley; when a pressure mechanism is provided for tensioning the cable in proportion to the load, said mechanism is associated with the pulley having the V-shaped groove.

4 Claims, 1 Drawing Figure

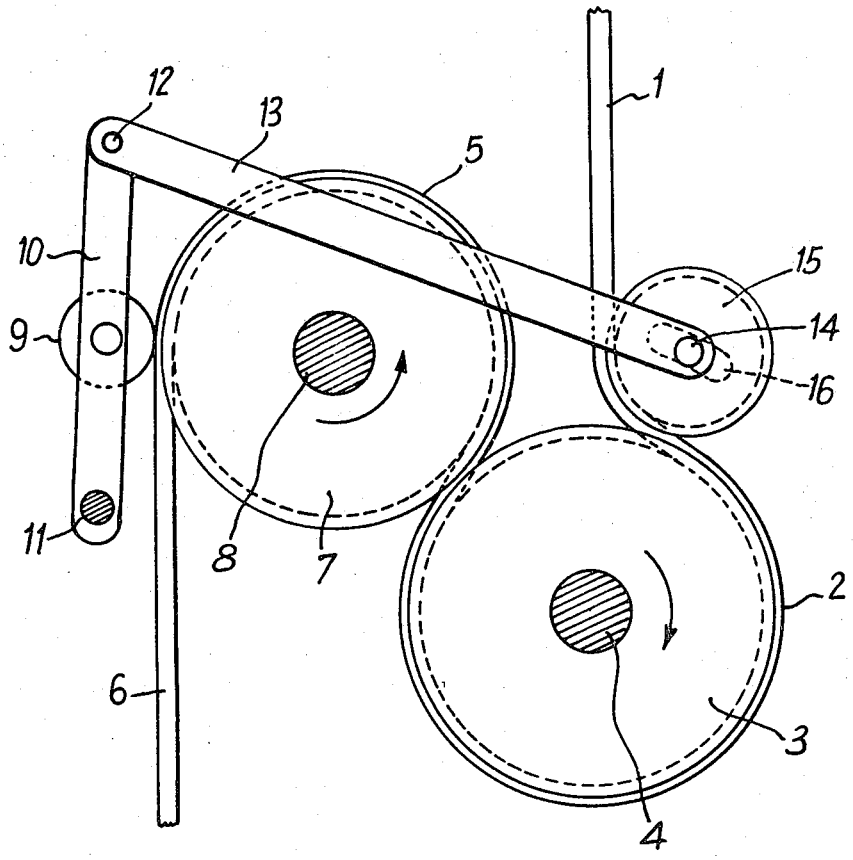
12
13
5
1
10
15
9
14
16
11
8
7
2
6
3
4

PULLEY ASSEMBLY FOR IMPROVING THE COOPERATION BETWEEN A WINCH AND A CABLE ACTUATED THEREBY

BACKGROUND OF THE INVENTION

1. FIELD OF THE INVENTION

The present invention is directed to a pulley assembly intended for improving the operative relationship between a winch and a cable or rope actuated thereby.

2. DESCRIPTION OF THE PRIOR ART

Hoisting apparatus, notably those intended for flying scaffolds and the like, wherein there are provided two or more pulleys around which the load-supporting cable or rope is or are caused to pass, are already known. These apparatus are so designed that the cable moves on the pulleys of the assembly without being wound on a drum, or at least, in the case of powered apparatus, on the drum driven by the hoisting motor.

Some of these known arrangements comprise a grooved pulley having a V-shaped groove or an equivalent cross-sectional contour in order to wedge or jam the cable so that the latter, due to the stress exerted by the load, is eventually more or less damaged.

Other known systems comprise only pulleys the grooves of which have a semi-circular cross-sectional contour which does not appreciably damage the cable but reduces the cable adherence, thus entailing considerably stronger cable pressing means constituting a cause of excessive stress of the component elements.

SUMMARY OF THE INVENTION

The present invention is directed, in a system of this character, to combine at least two pulleys disposed in coplanar relationship, the pulley receiving the load-supporting cable section having a semi-circular groove while the groove of the other pulley on which the stress caused by the load-responsive tightening mechanism acts has a V-shaped or equivalent cross-sectional contour capable of exerting a wedging action on the cable.

With this arrangement, the circular-grooved pulley, which cannot damage the cable, provides one fraction of the cable-retaining force by adherence, thus reducing the load exerted on the cable section engaging the other pulley, so that the retaining effort exerted by the second pulley is less pronounced.

When the arrangement comprises a presser mechanism for proportioning the tightening effort exerted on the cable as a function of load, this presser mechanism is associated with the second pulley having a V-shaped groove.

With the arrangement according to this invention, the efficiency and reliability of operation are substantially equivalent to those obtained with existing apparatus, but with a considerable reduction on the one hand of the crushing force exerted on the cable in the V-shaped groove and on the other hand of the force applied by the presser roller or mechanism.

Thus, a lesser risk of damaging the cable in the V-shaped groove is combined with a lesser stress exerted on the component elements of the self-tightening mechanism.

These various positive results may be enhanced by applying to the surface of the semi-circular grooved pulley a treatment consisting in spraying a material molten in a jet of ionized gaz passing through the arc of a plasma blowpipe. In fact, with this treatment it is possible to increase the coefficient of friction between the cable and the pulley to an extent unattained up to now with any other known industrial methods, so that, given a same load capacity, the mechanism can be simplified and lightened.

BRIEF DESCRIPTION OF THE DRAWING

The single FIGURE of the attached drawing illustrates diagrammatically in side elevational and sectional view a pair of pulleys, the section being taken in a plane perpendicular to the parallel shafts of these pulleys.

DESCRIPTION OF THE PREFERRED EMBODIMENT

In the drawing, the reference numeral 1 designates the taut end of the load supporting cable which passes at 2 around a first pulley 3 having a semi-circular groove section. This pulley 3 is rigid with a shaft 4. Then, the slack side 6 of the cable passes around a second pulley 7 rigid with a shaft 8 and having a V-shaped groove section; this pulley 7 rotates at the same velocity but in the opposite direction with respect to the first pulley 3, due to the provision of suitable and known mechanical coupling means (not shown) provided between pulleys 3 and 7, or between their shafts 4 and 8. In this case, one shaft may constitute the driving shaft.

The presser or cable-tensioning device engaging the cable section passing over the pulley 7 is illustrated diagrammatically in the form of a roller 9 carried by a lever 10 having one end fulcrumed to a fixed pivot pin 11 and the other end pivotally connected at 12 to a traction rod 13 supporting the shaft 14 of a loose pulley 15 around which the taut section 1 of the cable is caused to pass before engaging the groove of pulley 3; this shaft 14 is adapted to slide in elongated holes 16 formed in the two lateral walls of a case (not shown) supporting and enclosing the pulley assembly 3 and 7.

OPERATION

Assuming that the winch is intended for controlling the up or downward movements thereof along the cable of which the upper portion of section 1 is anchored to a fixed point, it is clear that the rotation of pulleys 3 and 7 in the direction shown by the arrows will cause the winch to move upwards together with the load suspended therefrom, and that when the pulleys 3, 7 rotate in the direction opposite the one shown by the arrows, the winch and its load will be allowed to move downwards without any risk of cable slip, since the cable is retained partly in the semi-circular groove of pulley 3 and partly in the V-groove of pulley 7 due to the action exerted by the presser roller 9 of which the force exerted on the cable is proportional to the load which tends to move the control pulley 15 away from the presser roller 9 by acting in the direction of application of this roller 9.

If, in contrast thereto, the winch is anchored to a fixed point and the cable section 1 is attached to a load to be hoisted, the operation is exactly the same except that in this case it is the cable that passes through the fixed winch in lieu of the forward or backward movement of the winch along the cable secured to one of its ends.

Of course, it will readily occur to those conversant with the art that the form of embodiment of the invention shown and described herein is given by way of illustration, not of limitation, since many modifications and changes may be brought thereto without departing from the basic principles of the invention as recited in the appended claims.

What I claim is:

1. A cable hoist apparatus comprising:

(i) a first pulley for driving in rotation in one direction, said pulley having a peripheral groove of which the cross-sectional shape is without cable-wedging action, (ii) a second pulley for driving in rotation at the same velocity in the other direction, said second pulley having a peripheral groove of which the cross-sectional shape provides cable-wedging action.

(iii) a presser means movable in the same plane towards and away from the peripheral groove of said second pulley, (iv) a third pulley having its axis of rotation movable in a common plane of rotation of the three pulleys, said third pulley being coupled to said presser means, and (v) a cable which, starting from a load-bearing portion thereof, is passed in said other direction about said third pulley and then in said one direction about said first pulley and then in said other direction about said second pulley, between said second pulley and said presser means, whereby force is exerted by said presser means to urge said cable into the peripheral groove of said second pulley in proportion to tension in the load-bearing portion of the cable tending to move the axis of the third pulley in said common plane.

2. A cable hoist apparatus, as claimed in claim 1, wherein said first pulley has a groove of semi-circular cross-section.

3. A cable hoist apparatus, as claimed in claim 1, wherein said second pulley has a groove of V-shaped cross-section.

4. A cable hoist apparatus, as claimed in claim 1, wherein said presser means comprises a lever carrying a freely rotatable roller abutting that portion of the cable engaged in the groove of the second pulley, said lever being coupled by a traction element to said third pulley.

* * * * *